US009662781B1

(12) United States Patent
Kao

(10) Patent No.: US 9,662,781 B1
(45) Date of Patent: May 30, 2017

(54) SOCKET HOLDING FRAME

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 15/183,733

(22) Filed: Jun. 15, 2016

(51) Int. Cl.
*A47F 7/00* (2006.01)
*B25H 3/00* (2006.01)
*B25H 3/04* (2006.01)

(52) U.S. Cl.
CPC ..... *B25H 3/003* (2013.01); *B25H 3/04* (2013.01)

(58) Field of Classification Search
CPC ..... B25H 3/003; B25H 3/04
USPC ..... 211/70.6, 69, 94.01; 206/378, 376, 372, 206/373, 349; 269/43, 95
See application file for complete search history.

(56) References Cited

U.S. PATENT DOCUMENTS 4,826,021 A * 5/1989 Burrell ..... B25H 3/003 211/70.6
5,228,570 A * 7/1993 Robinson ..... B25H 3/06 206/375
5,398,823 A * 3/1995 Anders ..... B25H 3/003 206/378
5,467,874 A * 11/1995 Whitaker ..... B25H 3/06 206/378
5,501,342 A * 3/1996 Geibel ..... B25H 3/003 206/350
6,070,745 A * 6/2000 Dembicks ..... B25H 3/06 206/378
6,375,005 B1 * 4/2002 McCann ..... B65D 73/0064 206/349
6,386,363 B1 * 5/2002 Huang ..... B25H 3/003 206/1.5
6,415,923 B1 * 7/2002 Chen ..... B25H 3/003 206/372
6,431,373 B1 * 8/2002 Blick ..... B25H 3/003 206/378
6,464,840 B1 * 10/2002 McCann ..... B25H 3/04 206/349
6,488,151 B2 * 12/2002 Ramsey ..... B25H 3/06 206/378
6,634,502 B1 * 10/2003 Yu ..... B25H 3/003 206/372
6,672,476 B2 * 1/2004 Cash ..... F41A 9/84 211/70.6
6,840,377 B2 * 1/2005 Yu ..... B25H 3/003 206/372
7,527,150 B2 * 5/2009 Tong ..... A47F 7/024 206/376

(Continued)

*Primary Examiner* — Joshua J Michener
*Assistant Examiner* — Devin Barnett
(74) *Attorney, Agent, or Firm* — Pai Patent & Trademark Law Firm; Chao-Chang David Pai

(57) ABSTRACT

A socket holding frame has a track base and at least one positioning mount. The track base has a bottom panel and a slide rail. The bottom panel has multiple first engaging segments formed on a top surface of the bottom panel. The at least one positioning mount is slidably and rotatably mounted on the track base, and each one of the at least one positioning mount has a sliding seat and an extending element. The sliding seat is slidably and rotatably mounted in the slide rail and has multiple second engaging segments. The multiple second engaging segments engage with the multiple first engaging segments on the bottom panel. The extending element is formed on the sliding seat and extends out of the slide rail.

6 Claims, 6 Drawing Sheets

(56) References Cited

U.S. PATENT DOCUMENTS 7,565,973 B2 * 7/2009 Chang ..... B65D 73/0064 206/378
7,658,284 B2 * 2/2010 Lin ..... B25H 3/003 206/378
7,841,480 B2 * 11/2010 Hsieh ..... B25H 3/06 206/378
8,152,003 B1 * 4/2012 Kao ..... B25H 3/04 211/70.6
8,813,957 B1 * 8/2014 Kao ..... B25H 3/003 206/378
9,114,509 B2 * 8/2015 Lovely ..... B25B 13/463
9,186,790 B1 * 11/2015 Kao ..... B25H 3/06
2002/0027092 A1 * 3/2002 Hu ..... B65D 73/0064 206/378
2003/0034316 A1 * 2/2003 Kao ..... B25H 3/04 211/70.6
2003/0052069 A1 * 3/2003 Santa Cruz ..... A47F 7/0028 211/70.6
2005/0221664 A1 * 10/2005 Winnard ..... B25H 3/003 439/510
2006/0207951 A1 * 9/2006 Wang ..... A47F 7/024 211/70.6
2007/0007156 A1 * 1/2007 Wu ..... B65D 73/0064 206/376
2008/0128370 A1 * 6/2008 Shih ..... B25H 3/003 211/70.6
2008/0302743 A1 * 12/2008 Chen ..... A47F 5/0006 211/70.6
2011/0089126 A1 * 4/2011 Hsieh ..... B25H 3/003 211/70.6
2012/0138553 A1 * 6/2012 Kao ..... B25H 3/06 211/70.6
2013/0037498 A1 * 2/2013 Kao ..... B25H 3/04 211/59.2
2013/0062480 A1 * 3/2013 Kao ..... B25H 3/04 248/201
2013/0306581 A1 * 11/2013 Kao ..... A47B 81/00 211/49.1
2015/0034518 A1 * 2/2015 Kao ..... B65D 1/36 206/372
2015/0034572 A1 * 2/2015 Kao ..... B25H 3/04 211/13.1
2015/0122750 A1 * 5/2015 Kao ..... B25H 3/04 211/13.1
2015/0202767 A1 * 7/2015 Kao ..... F16M 13/022 211/70.6
2016/0096264 A1 * 4/2016 Kao ..... B25H 3/06 206/378

* cited by examiner

SOCKET HOLDING FRAME

BACKGROUND OF THE INVENTION

1. Field of the Invention

The present invention relates to a socket holding frame, and more particularly to a socket holding frame that may provide a positioning effect to sockets that are mounted on the socket holding frame.

2. Description of Related Art

A conventional socket holding frame has a track base and multiple positioning mounts slidably mounted on the track base. The positioning mounts are used to hold sockets on the track base to allow a user to look for the marks of sizes or model numbers on outer peripheries of the sockets by rotating the sockets. To move or rotate the sockets easily and quickly, the track base is not set up with any fixing structure for fixing the positioning mounts with the track base. Hence, the positioning mounts may be moved or rotated by impact or hit by an unexpected force, such that the user has to frequently and repeatedly look for the marks of sizes or model numbers of the sockets, which is very inconvenient in use.

To overcome the shortcomings of the conventional socket holding frame, the present invention provides a socket holding frame to mitigate or obviate the aforementioned problems.

SUMMARY OF THE INVENTION

The present invention relates to a socket holding frame that may provide a positioning effect to sockets that are mounted on the socket holding frame.

The socket holding frame has a track base and at least one positioning mount. The track base has a bottom panel and a slide rail. The bottom panel has multiple first engaging segments formed on a top surface of the bottom panel. The at least one positioning mount is slidably and rotatably mounted on the track base, and each one of the at least one positioning mount has a sliding seat and an extending element. The sliding seat is slidably and rotatably mounted in the slide rail and has an engaging flange. The engaging flange has multiple second engaging segments and a sliding groove. The multiple second engaging segments are formed on a bottom surface of the engaging flange and engage with the multiple first engaging segments of the bottom panel. The sliding groove is defined in and diametrically extends through the bottom surface of the engaging flange. The extending element is formed on the sliding seat and extends out of the slide rail.

Other objects, advantages, and novel features of the invention will become more apparent from the following detailed description when taken in conjunction with the accompanying drawings.

DETAILED DESCRIPTION OF PREFERRED EMBODIMENT

Figure 1:
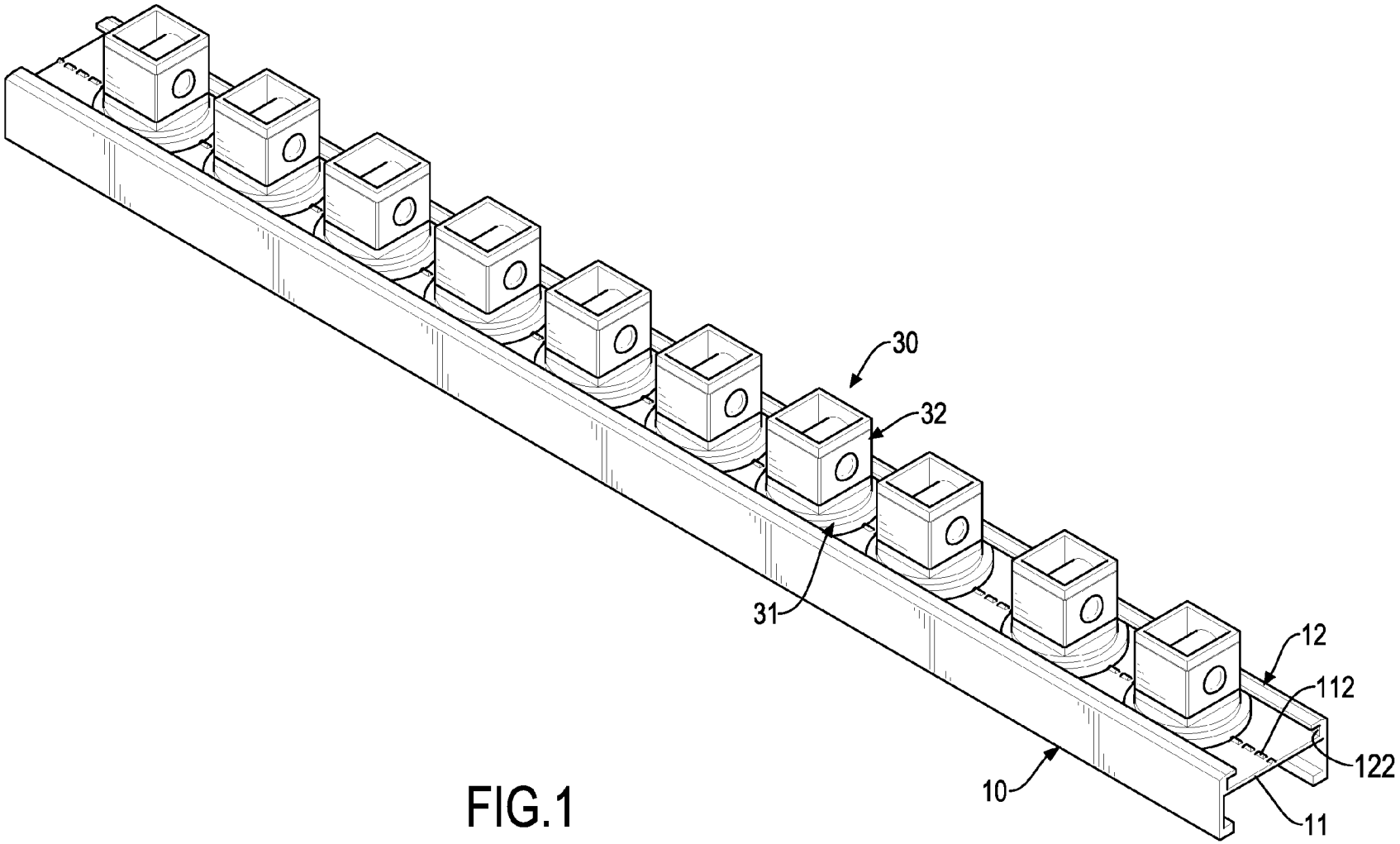
FIG. 1 is a perspective view of a socket holding frame in accordance with the present invention.

With reference to FIGS. 1 to 4, a first embodiment of a socket holding frame in accordance with the present invention comprises a track base 10 and at least one positioning mount 30.

The track base 10 is made of metal, is preferably made of aluminum, is elongated, and has a bottom panel 11, a slide rail 12, and a bottom track 14. The bottom panel 11 is elongated and has a top surface, a bottom surface, and multiple first engaging segments 112. The multiple first engaging segments 112 are formed on and protrude from the top surface of the bottom panel 11 at spaced intervals. The first engaging segments 112 are aligned in a straight line and are preferably formed at the middle of the top surface of the bottom panel 11 at spaced intervals. An engaging space 114 is formed between adjacent two of the first engaging segments 112.

The slide rail 12 is formed on and protrudes from the top surface of the bottom panel 11 and has a top side, a top opening 121, and a sliding recess 122. The top opening 121 is formed through the top side of the slide rail 12. The sliding recess 122 is formed in the slide rail 12 between the top side of the slide rail 12 and the top surface of the bottom panel 11 and communicates with the top opening 121. The bottom track 14 is formed on and protrudes from the bottom surface of the bottom panel 11 and has a bottom side and a bottom opening 141. The bottom opening 141 is formed through the bottom side of the bottom track 14. In addition, the bottom track 14 and the slide rail 12 are formed on the bottom panel 11 as a single piece.

The at least one positioning mount 30 is slidably and rotatably mounted on the track base 10, and each one of the at least one positioning mount 30 has a sliding seat 31 and an extending element 32. The sliding seat 31 is round in cross section and is elastic, is slidably and rotatably mounted in the sliding recess 122 of the slide rail 12, and engages with two of the multiple first engaging segments 112 of the bottom panel 11. The sliding seat 31 has a bottom side, a top side, and an engaging flange 311. The bottom side of the sliding seat 31 engages with two of the multiple first engaging segments 112 on the bottom panel 11. The top side of the sliding seat 31 faces the top opening 121 of the slide rail 12.

The engaging flange 311 is formed on and protrudes downwardly from the bottom side of the sliding seat 31 and has a bottom surface, multiple second engaging segments 312, and a sliding groove 314. The multiple second engaging segments 312 are continuously formed in the bottom surface of the engaging flange 311 of the sliding seat 31 at spaced intervals, and are arranged annularly along the bottom surface of the engaging flange 311. Each one of the multiple second engaging segments 312 engages with two of the multiple first engaging segments 112. Additionally, each one of the multiple second engaging segments 312 is a recess. The sliding groove 314 is defined in and diametrically extends through the bottom surface of the engaging flange 311.

The extending element 32 is formed on and protrudes upwardly from the top side of the sliding seat 31 and extends out of the slide rail 12 via the top opening 121. Furthermore, the extending element 32 of each one of the at least one positioning mount 30 is an insertion button. The extending element 32 is hollow, is rectangular, and has a side surface and a protruding ball 321. The protruding ball 321 is mounted in and extends outwardly from the side surface of the insertion button.

Figure 2:
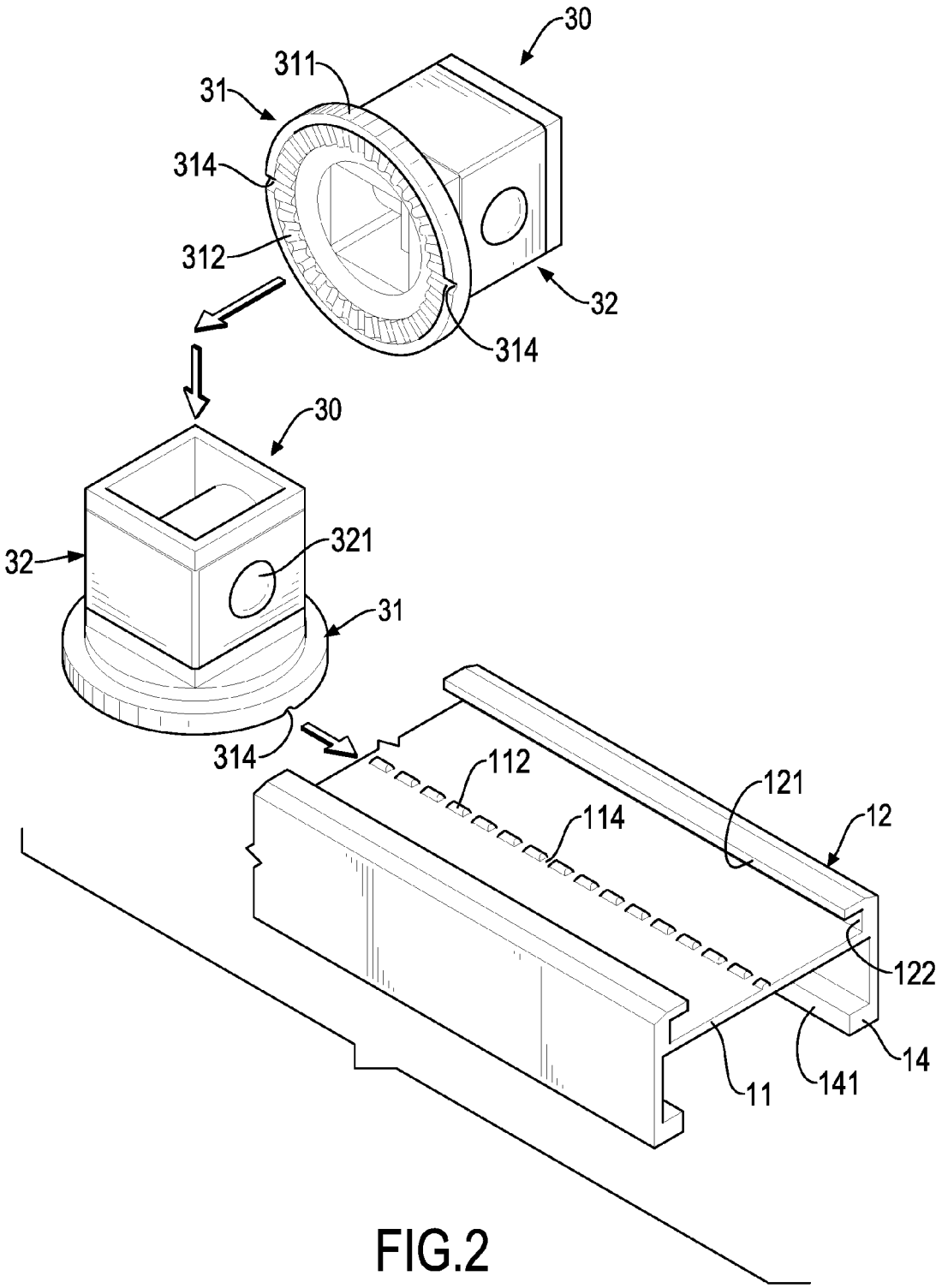
FIG. 2 is an enlarged exploded perspective view of the socket holding frame in FIG. 1.
Figure 3:
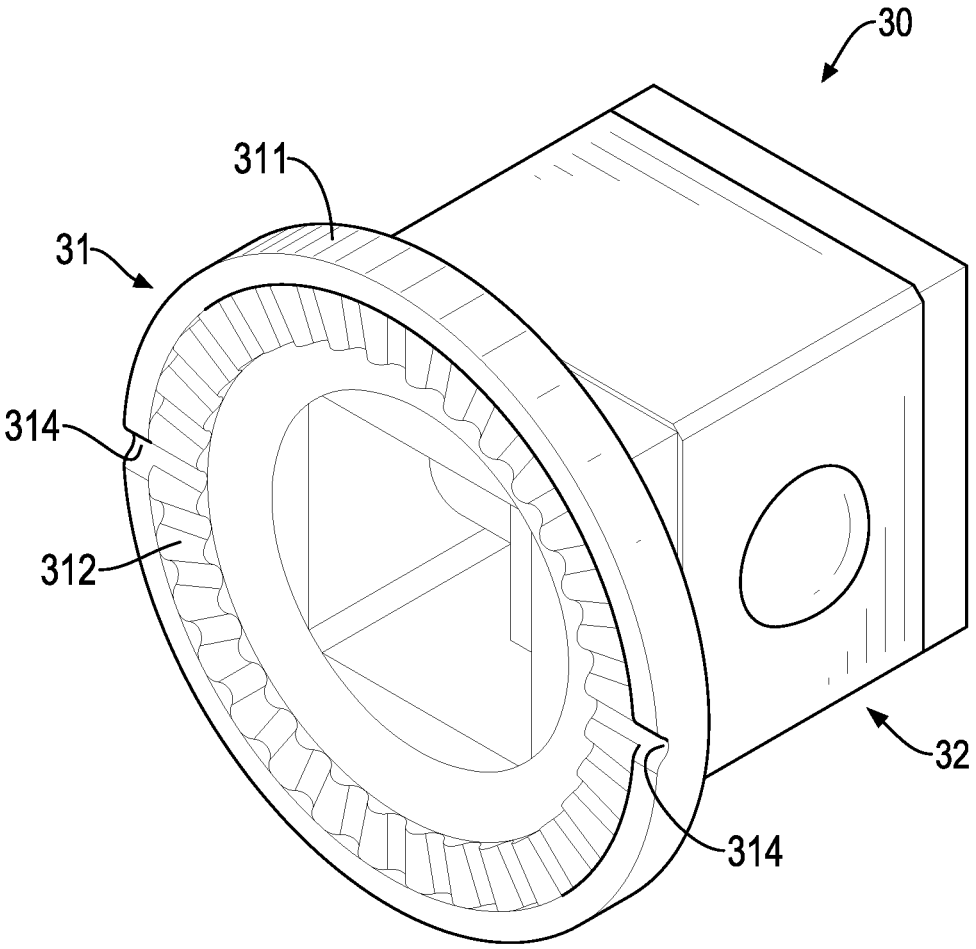
FIG. 3 is an enlarged perspective view of a positioning mount of the socket holding frame in FIG. 1.
Figure 4:
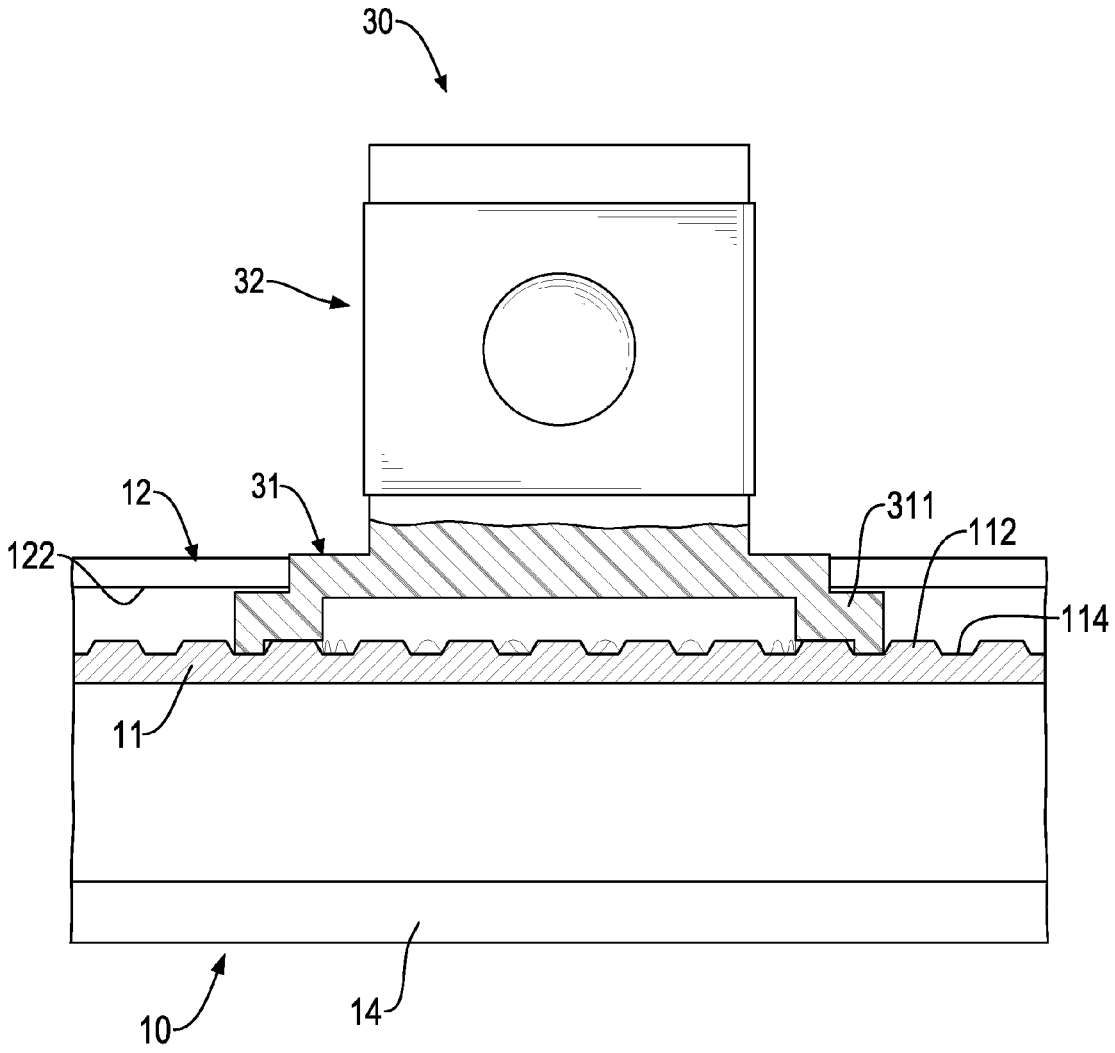
FIG. 4 is an enlarged side view in partial section of the socket holding frame in FIG. 1.
Figure 5:
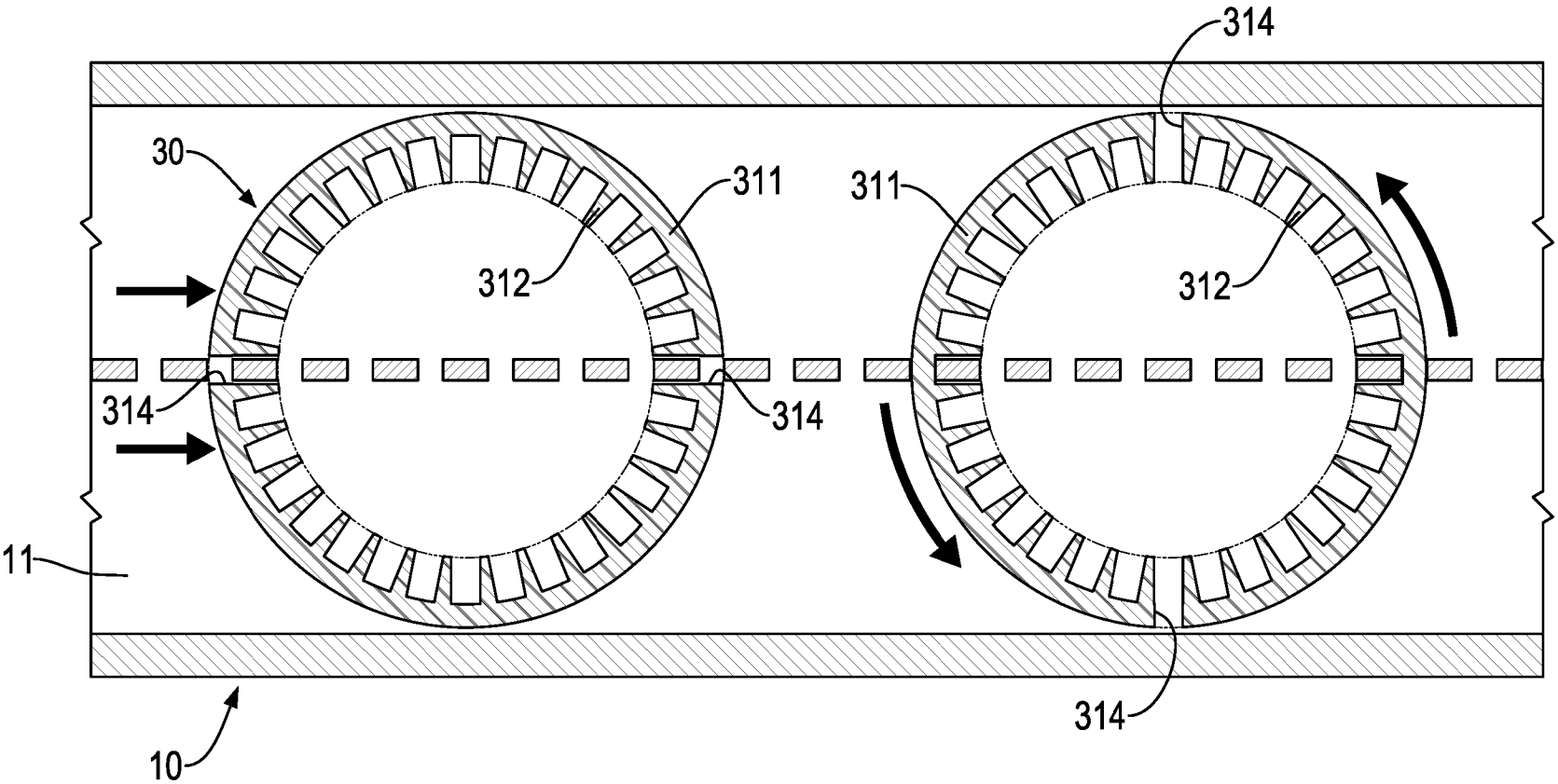
FIG. 5 is an enlarged operational cross sectional top view of the socket holding frame in FIG. 1.

With reference to FIGS. 2, 4, and 5, to attach each positioning mount 30 onto the track base 10, the positioning mount 30 is rotated to align the sliding groove 314 with the first engaging segments 112. The positioning mount 30 is then put into the sliding recess 122 in the slide rail 12 from one end of the track base 10. Consequently, the positioning mount 30 can be moved to a desired position along the first engaging segments 112. Then, the positioning mount 30 is rotated relative to the track base 10 to engage one of the second engaging segments 312 on the engaging flange 311 with two of the first engaging segments 112. With the engagement between the first engaging segments 112 and the second engaging segment 312, the positioning mount 30 can be positioned relative to the track base 10.

Figure 6:
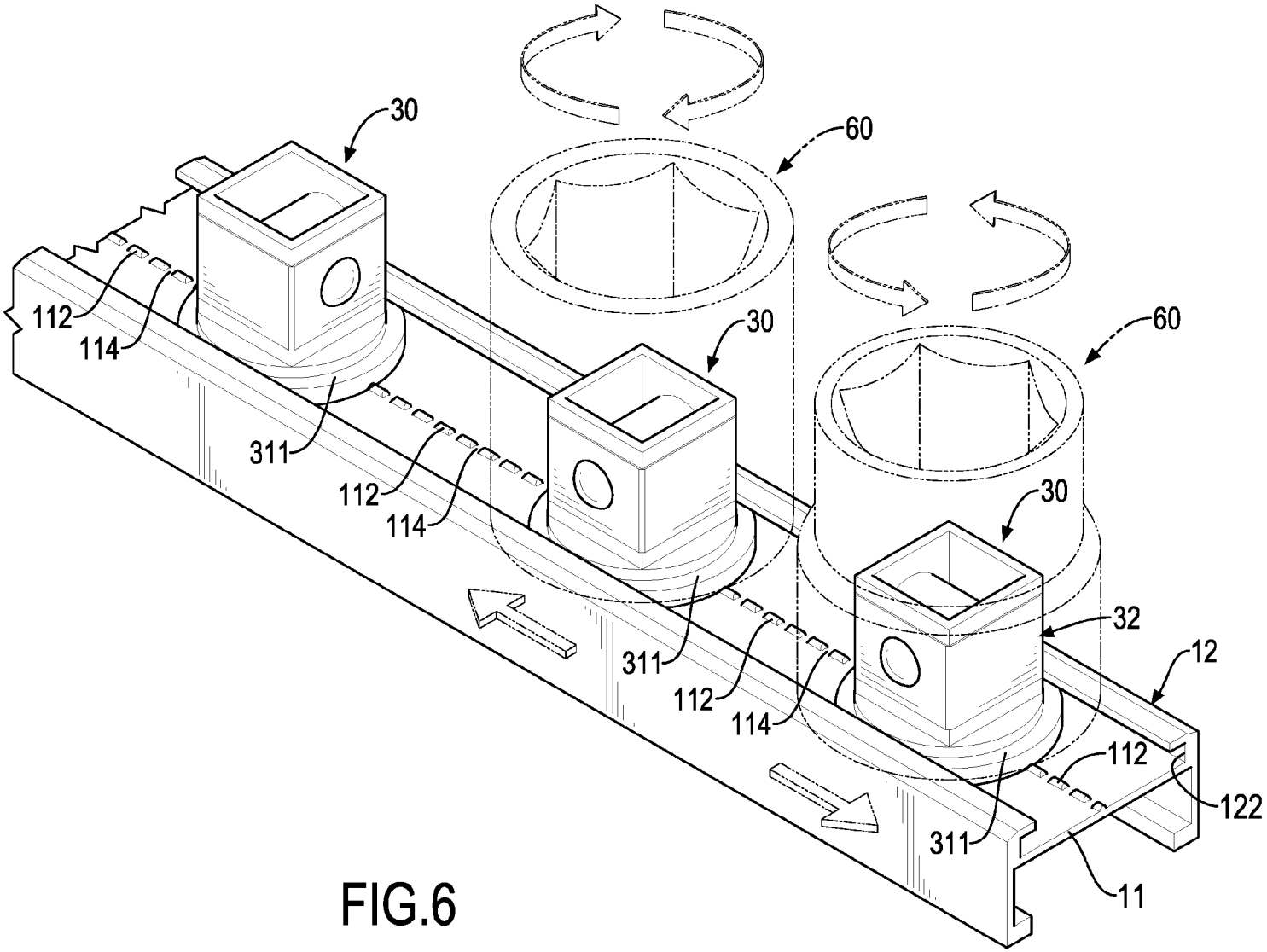
FIG. 6 is an enlarged operational perspective view of the socket holding frame in FIG. 1.

With reference to FIG. 6, when the socket holding frame in the present invention is in use, the socket holding frame has multiple positioning mounts 30 mounted on the track base 10, and multiple sockets 60 are respectively and detachably mounted around the extending elements 32 of the positioning mounts 30. When each socket 60 is mounted around the extending element 32 of a corresponding positioning mount 30, the protruding ball 321 of the extending element 32 engages with a recess in an inner wall of the socket 60. Consequently, the sockets 60 are positioned on the extending elements 32 of the positioning mounts 30. When numbers or signs on the sockets 60 are not aligned at a same direction to face a user, the user may rotate the sockets 60 in a clockwise or counterclockwise direction relative to the track base 10 as shown in FIG. 6 to enable the numbers or signs of the sockets 60 to face the user. During the above-mentioned rotating process, the sliding seats 31 of the positioning mounts 30 may be rotated with the sockets 60 relative to the track base 10 by the engagement between the extending elements 32 of the positioning mounts 30 and the sockets 60.

When the sockets 60 are rotated to enable the numbers or signs on the sockets 60 to face the user, the engagement between the multiple second engaging segments 312 and the multiple first engaging segments 112 enables the sliding seats 31 to engage with the track base 10. That is, the engagement between the multiple second engaging segments 312 and the multiple first engaging segments 112 provides a positioning effect to the positioning mounts 30 on the track base 10. Therefore, the positioning mounts 30 may be positioned securely on the track base 10 at desired positions, and the user may recognize the sizes of the sockets 60 by the numbers or signs easily and conveniently.

To adjust the position of the sockets 60 or the positioning mounts 30, the socket 60 or the positioning mount 30 is rotated relative to the track base 10 to align the sliding groove 314 with the first engaging segments 112. Accordingly, the socket 60 or the positioning mount 30 can be moved along the track base 10 rapidly to fit with different demands of use.

What is claimed is:

1. A socket holding frame comprising:

a track base being elongated and having a bottom panel having a top surface, a bottom surface opposite to the top surface, two opposite sides, and two opposite ends;

a pair of generally L-shaped slide rails formed on and protruding from the top surface of the bottom panel, each slide rail having a top side;

wherein a sliding recess is defined between the top side of each slide rail and the top surface of the bottom panel;

wherein the pair of slide rails are opposed to each other along the opposite sides of the bottom panel; wherein a top opening is defined between the top sides of the pair of slide rails; wherein multiple first engaging segments protrude upwardly from the top surface of the bottom panel and are aligned in a straight line at spaced intervals;

at least one positioning mount slidably and rotatably mounted on the track base between the sliding rails, each positioning mount having a sliding seat slidably and rotatably mounted in the sliding recesses of the slide rails and having a bottom side, a top side opposite the bottom side facing the top opening defined by the slide rails, an extending element formed on and protruding upwardly from the top side of the sliding seat, the extending element extending out of the slide rails via the top opening, wherein the extending element is sized and configured to receive a corresponding socket in order to mount at least one socket to the socket holding frame, an engaging flange formed on and protruding downwardly from the bottom side of the sliding seat, the engaging flange having a generally ring shaped bottom surface, multiple teeth formed on the bottom surface of the engaging flange at spaced intervals, wherein multiple second engaging segments in the form of depressions are defined at each spaced interval between adjacent teeth, wherein the depressions are sized to mate with the first engaging segments, and a sliding groove defined in and diametrically extending through the bottom surface of the engaging flange;

wherein, when in use, the at least one positioning mount is inserted between the slide rails and rotated until a corresponding pair of the first engaging segments are inserted within a corresponding pair of depressions in order to securely mount the at least one positioning mount to the track base.

2. The socket holding frame as claimed in claim 1, wherein the track base has a bottom track formed on and protruding from the bottom surface of the bottom panel, and having a bottom opening formed through a bottom surface of the bottom track.

3. The socket holding frame as claimed in claim 2, wherein the bottom track, the slide rails, and the bottom panel are formed as a single piece.

4. The socket holding frame as claimed in claim 3, wherein the first engaging segments are formed at the middle of the top surface of the bottom panel.

5. The socket holding frame as claimed in claim 2, wherein the first engaging segments are formed at the middle of the top surface of the bottom panel.

6. The socket holding frame as claimed in claim 1, wherein the first engaging segments are formed at the middle of the top surface of the bottom panel.

* * * * *